United States Patent [19]

Bauer

[11] Patent Number: 5,005,842

[45] Date of Patent: Apr. 9, 1991

[54] DART QUARTERBACK

[76] Inventor: Brian A Bauer, 321 W. Main St., Hartford City, Ind. 47348

[21] Appl. No.: 502,244

[22] Filed: Mar. 30, 1990

[51] Int. Cl.[5] ..... F41J 3/00

[52] U.S. Cl. ..... 273/408; 273/94; 273/409

[58] Field of Search ..... 273/408, 409, 94

[56] References Cited

U.S. PATENT DOCUMENTS 3,979,117 9/1976 Worsham ..... 273/94 R X 4,681,325 7/1987 Sheem ..... 273/94 X

*Primary Examiner*—William H. Grieb

[57] ABSTRACT

A dart football game with a singular, circuit dart board, in which the object is to pierce the center area of the said board, whereas a plurality of darts piercing a donut shaped area, called the completion zone, directly surrounding the centermost area, add to equal at least one point, although any single dart that pierces said centermost area, each score a point; additionally said game has four other circular, instant point areas, other than said centermost area, barely within said board parameters, located at twelve, three, six, and nine O'clock, all being open targets at to which each, individual player throws a multitude of at least eight(8) or more darts at a time, for four rounds or quarters, whereby each quarter or round has a player total as the game progresses, as said game can be played by one to numerous people.

1 Claim, 1 Drawing Sheet

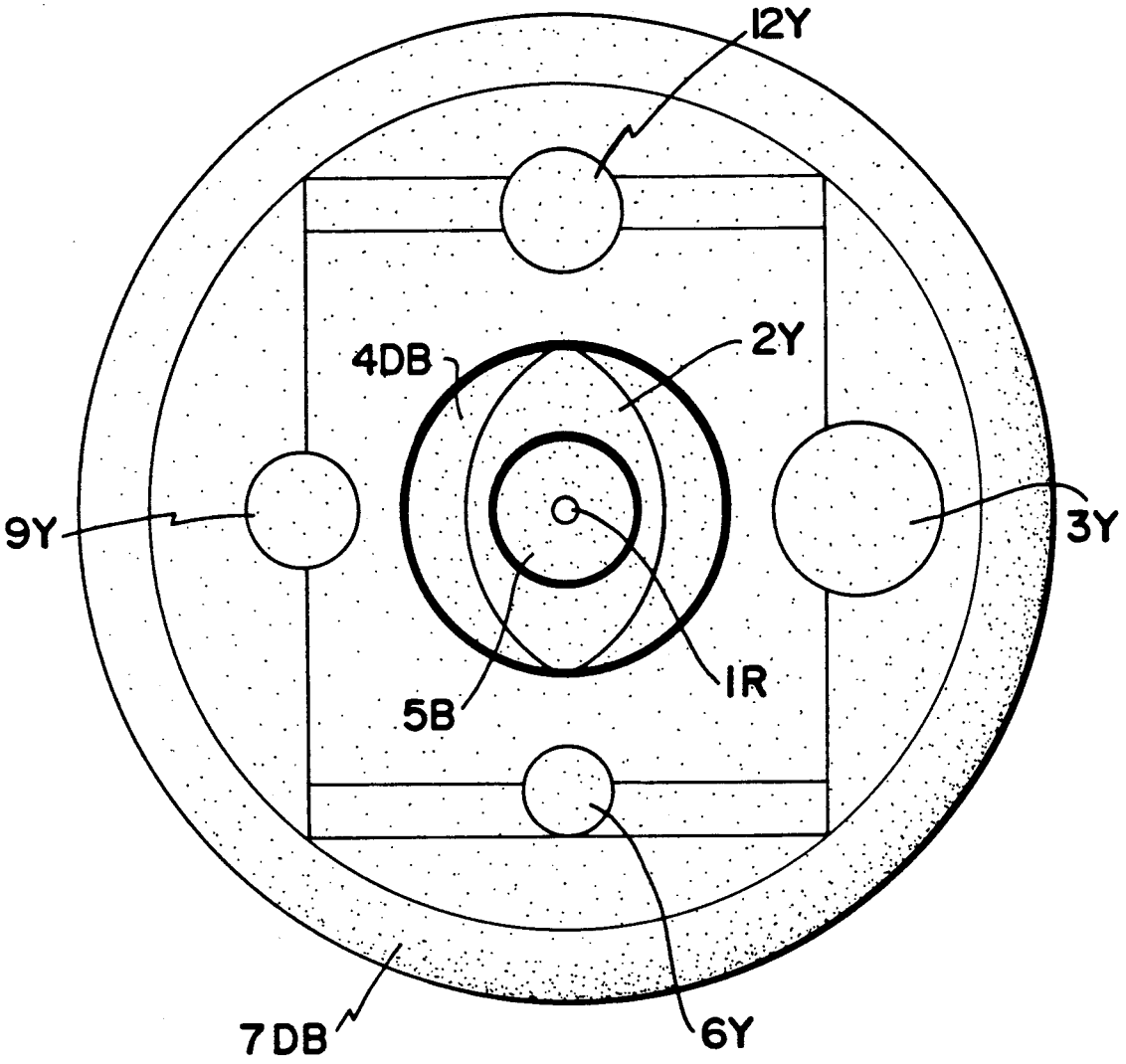
12Y
4DB
2Y
9Y
3Y
1R
5B
7DB
6Y

DART QUARTERBACK

DART QUARTERBACK is associated with controlled accuracy in regard to the center of the dartboard. The game was conceived from the standardized version of baseball, which has been on dart boards for years. I have devised a better suited board for the game strategy (enclosed).

The game can be played by one to ? people, although more than four players could make the game rather time consuming, unless the number of rounds per player is reduced.

BRIEF DESCRIPTION OF THE DRAWING

The single FIG. shows a view of the dart board of the invention.

The standard game consists of 4 quarters, or in other words, each player gets 4 rounds of darts. Each round, or quarter, encompasses each player throwing 12 darts a piece (48 darts per player a game), and totalling their score.

To understand the scoring, please refer to the enclosed game board picture, The strategy centers around the blue circle 5B inside the football, including the bullseye 1R. The blue circle inside the yellow football 24 represents a touchdown, whereas the bullseye is considered only as a focal point, and does not count any extra, thus it is considered part of the blue circle touchdown area. You may be asking why the center is strategic. The answer is in the area directly outside the inner blue circle, including the yellow football, extending to cover another blue area 40B with its border being a thin, yellow banded circle. A dart in the previously described area is call a "completion". Three (3) darts in the completion area result in point (touchdown); so in essence a player could "complete" all 12 darts (very rare chance), without a direct touchdown, but still get 4 points (TDs) from "completed" darts!Most regularly 1 or 2 points (TDs) respectively 3 or 6 dart completions are common, without considering the directly precise touchdown shots!

The other yellow circles 3Y, 6Y, 9Y, 12Y also represent touchdown areas, thus bringing the amount of touchdown areas to five (5) circles. These added touchdown areas (yellow circles) allow the "stray" shot to pay off, and also allow the shooter an alternative target when the center is crowded. The yellow touchdown circles boarder a danger zone, which is the outermost part of the board. The dark blue outermost band 70B is an interception (−1point/touchdown) zone. A dart that misses the entire board is not penalized, as it is considered a pass "into the crowd"for an incomplete.

SPECIFIC RULES

The official distance for shooting is 9'4" from the target. Once a dart pierces a touchdown area, and has stuck long enough for all the participants to acknowledge, it is considered a touchdown, even if it falls after a second. Darts that bounce off the target or another dart are incomplete. The converse is true when ruling on "completion" or "intercepted" (most-outer band) darts. A completion dart is only counted if it is stuck after all the darts from that player have been thrown. The same is true of intercepted darts, as they are only counted toward the players score at the end of his/her round/quarter.

For more or less skilled players the distance from the target can be manipulated to provide ultimate competitioin! When playing dart Quarterback solo, the player can compete against an arbitrary number each quarter. A competitive number would be 4 points/-touchdowns a quarter. So to win the solo player must beat a score of 16 points in the four quarter game. If in the case of a tie, an overtime round will be continued until a winner is decided both in solo play and with additional players.

TIME-OUT STRATEGY

Each player gets one (1) time-out per quarter. The time-out is strategic as the player gets to their final darts of the quarter. During this time the player counts the number of completions to determine if they are lacking the multiple of three darts for touchdown/point purposes. if the player already has 3,6,9,. . . completions, another completion or two will not result in a completion point. Therefore the best strategy would be to try for the touchdown circles with the remaining darts. In other words the time-outs answer the question, "Do I need to shoot for a completion, or go for a touchdown!" Whenever a dart is "on the border line", the players should call an "official" time-out to "referee" the questionable shot, because if it is an agreed upon touchdown, it is a point/touchdown, even if the dart is knocked out during the following shots!

PROGRESSIVE IDEAS

The size of the scoring areas could be reduced, on the other side of the board, for advanced players. Another idea for variation could be the use of two more darts, making the total number of darts thrown per quarter to 14, per game 56.

What I Claim is:

1. A dart football comprising:

(a) singular, circular dart board target means for receiving a multitude of at least 8 darts therein;

(b) said dart board consists of centralized, donut shaped area as a means for scoring a plurality of darts therein, to attain a point;

(c) center, circular, donut hole, of said centralized donut shaped area, being centermost of said board and encompassing the bullseye, wherein pierced by each, and every dart therein results in a point or touchdown, whereas;

d) four other circular areas exist, in relation to said center, circular donut hole, in relation to point or touchdown value results, and approximate circular diameters, whereby located toward the outermost parameters of said board at twelve, three, six, and nine o'clock, as each, and every dart within said other, circular areas, also results in a point or touchdown;

(e) each player throws at least 8 darts, and less than 15 darts, successively, for 4 rounds or quarters, to complete an entire game, as each players score is totalled after each round or quarter, unless a tie results after the fourth round or quarter, whereby overtime rounds or quarters continue, one by one, until a winner is declared;

(f) competition by a solo player is possible on said board by competing against a prescribed, equal number of points or touchdowns per round or quarter, and thus the sum per game, whereby said prescribed equal number of points or touchdowns represents between 33–40 % of the total mount of darts thrown in single round or quarter.

* * * * *